US007566119B2

(12) United States Patent
Ito

(10) Patent No.: US 7,566,119 B2
(45) Date of Patent: Jul. 28, 2009

(54) INKJET PRINTHEAD AND METHOD OF PRODUCING THE SAME

(75) Inventor: Atsushi Ito, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 430 days.

(21) Appl. No.: 11/316,081

(22) Filed: Dec. 21, 2005

(65) Prior Publication Data

US 2006/0132552 A1 Jun. 22, 2006

(30) Foreign Application Priority Data

Dec. 22, 2004 (JP) ..... 2004-371844

(51) Int. Cl.
*B41J 2/045* (2006.01)

(52) U.S. Cl. ..... 347/71; 347/68

(58) Field of Classification Search ..... 347/71
See application file for complete search history.

(56) References Cited

U.S. PATENT DOCUMENTS

| | | | | |
|---|---|---|---|---|
| 5,402,159 | A | 3/1995 | Takahashi et al. | |
| 5,748,214 | A | 5/1998 | Usui et al. | |
| 2003/0210307 | A1* | 11/2003 | Ito et al. | 347/71 |
| 2003/0222949 | A1 | 12/2003 | Ito | |
| 2005/0162485 | A1 | 7/2005 | Ito | |

FOREIGN PATENT DOCUMENTS

| | | |
|---|---|---|
| JP | 4341853 | 11/1992 |
| JP | B23296391 | 6/2002 |
| JP | 2004160874 | 6/2004 |
| JP | 2004223880 | 8/2004 |

* cited by examiner

*Primary Examiner*—Matthew Luu
*Assistant Examiner*—Lisa M Solomon
(74) *Attorney, Agent, or Firm*—Reed Smith LLP

(57) ABSTRACT

An inkjet printhead including a cavity unit formed by laminating plates including a first plate through which through-holes are formed, and a second plate laminated on one surface of the first plate, the cavity unit having: a common ink chamber accommodating ink; pressure chambers to which the ink is distributed from the common ink chamber; nozzles which are communicated with the pressure chambers, and through each of which an ink droplet is ejected; and connecting passages connecting the common ink chamber with the pressure chambers, a part of each connecting passage being constituted by a groove formed along the one surface of the first plate and open in the one surface, an open end of the groove being covered by the second plate, and one of opposite ends of the groove being connected to the through-hole, the groove including: an orifice portion at which a cross-sectional area of the connecting passage as taken in a direction perpendicular to a direction of flow of the ink is minimized in the connecting passage; and an enlarged portion continuously interposed between an end of the orifice portion and an open end portion of the through-hole, the cross-sectional area of the connecting passage being larger at the enlarged portion than at the orifice portion.

18 Claims, 8 Drawing Sheets

INKJET PRINTHEAD AND METHOD OF PRODUCING THE SAME

INCORPORATION BY REFERENCE

The present application is based on Japanese Patent Application No. 2004-371844, filed on Dec. 22, 2004, the content of which is incorporated herein by reference.

BACKGROUND OF THE INVENTION

1. Field of the Invention

The invention relates to an inkjet printhead applicable to an image forming apparatus which records information or others on a recording medium by ejecting ink droplets from a plurality of nozzles.

2. Description of Related Art

There is known an inkjet printhead including a cavity unit and a piezoelectric actuator laminated on the cavity unit. In the cavity unit are formed a plurality of ink passages each constituted by a common ink chamber, a pressure chamber, a connecting passage that connects the common ink chamber with the pressure chamber, and a nozzle in communication with the pressure chamber, such that ink as supplied from an ink supply source into the common ink chamber is distributed to a plurality of the pressure chambers via a plurality of the connecting passages and then flows to the nozzles, along the ink passages. By selectively applying a pressure to the ink in a pressure chamber by driving the piezoelectric actuator, a droplet of the ink is ejected from a nozzle corresponding to the pressurized ink chamber.

For instance, in cavity units disclosed in JP-A-2004-223880 (see FIGS. 3 to 5) and JP-A-2004-160874 (see FIG. 3), an ink passage is formed by laminating a plurality of plates in which recesses and/or through-holes are formed, such as a plate where nozzles are formed, a plate where pressure chambers are formed, a plate where common ink chambers are formed, and a plate where connecting passages that connect the pressure chambers with the respectively corresponding common ink chambers.

In the cavity units of the above-mentioned publications, the connecting passage between each pressure chamber and the common ink chamber includes an orifice portion for restricting flow of the ink so that the pressure applied to the pressure chamber is efficiently transmitted to the nozzle. That is, the orifice portion damps out a pressure wave coming from the pressurized pressure chamber to the common ink chamber. In the first publication, i.e., JP-A-2004-223880, such orifice portions are formed in a first one of two plates sandwiched between the plate in which the common ink chambers are formed and the plate in which the pressure chambers are formed, which first plate is on the side of the plate in which the common ink chambers are formed. In the second publication, i.e., JP-A-2004-160874, the orifice portions are formed in the plate in which the pressure chambers are formed, such that the orifice portions are continuous from the pressure chambers.

More specifically, in the first publication, each orifice portion takes the form of a groove having a depth D and extending along a major surface of the first plate, and an end of the groove is connected to a through-hole formed through the first plate while the other end of the groove constitutes a terminal portion communicated with the pressure chamber. That is, the orifice portion extends between the through-hole and the terminal portion, and a width of the orifice portion, which is a dimension thereof in a direction perpendicular to a direction of flow of the ink, is W1 that is smaller than a width or a dimension W2 of the through-hole in the same direction and a width or a dimension W3 of the terminal portion in the same direction. Thus, a cross-sectional area of the connecting passage is reduced at the orifice portion so as to increase a resistance to the ink flow there.

In the second publication, the orifice portion takes the form of a groove formed to have a depth D in a major surface of the plate, similarly to the orifice portion in the first publication. An end of the orifice portion is directly connected with a pressure chamber formed through the thickness of the plate, and the other end of the orifice portion constitutes a terminal portion communicated with the common ink chamber. This orifice portion is also between a through-hole in the form of the pressure chamber and the terminal portion, and a width of the orifice portion or a dimension thereof in a direction perpendicular to the ink flow is W1 that is smaller than that W2 of the pressure chamber and that W3 of the terminal portion, thereby reducing a cross-sectional area of the connecting passage at the orifice portion to increase a resistance to the ink flow there.

Orifice portions such as those disclosed in the first and second publications are typically formed in a metal plate by wet etching. Where the through-holes or the pressure chambers and the grooves (i.e., the orifice portions and terminal portions) are continuously formed in a same plate, as described above, it is typical that the through-holes or the pressure chambers are first formed through the plate, and then the orifice portions are formed by "half etching", that is, by etching away the material of the plate halfway in a direction of its thickness. The wet etching is performed such that an etchant is flowed on one surface of the plate in which the grooves are open, with each part not to be etched in both of opposite surfaces of the plate being covered with a protective film.

When the orifice portions are formed by half etching, the through-holes or the pressure chambers are already formed. Hence, around the through-holes or the pressure chambers, the etchant tends to flow more rapidly and a speed at which the etching process proceeds is accordingly higher at this place than at the other places. In addition, at a boundary between the through-hole or the pressure chamber and the orifice portion in each connecting passage, the width of an ink passage or the connecting passage decreases from W2 to W1 as well as the depth decreases from the entire thickness of the plate down to D, and an edge portion protruding inward is formed. Since at this boundary the etching speed is high and the etching process is excessively promoted, the edge portion is etched away so that the width W1 and the depth D at a part of the orifice portion on the side of the through-hole or the pressure chamber become larger than their design values. Thus, a problem is caused that although the resistance of the orifice portion to the ink flow is regulated by suitably determining the cross-sectional area of the orifice portion, the finished orifice portion does not have dimensions precisely as designed.

SUMMARY OF THE INVENTION

This invention has been developed in view of the above-described situations, and it is therefore an object of the invention to provide an inkjet printhead which enables to form with high precision and stability an orifice portion of a connecting passage connecting a common ink chamber and a pressure chamber, which orifice portion restricts ink flow. It is another object of the invention to provide a method of producing such an inkjet printhead.

To attain the above object, the invention provides an inkjet printhead including a cavity unit formed by laminating a plurality of plates which include a first plate through which a plurality of through-holes are formed, and a second plate laminated on one surface of the first plate. The cavity unit has: a common ink chamber accommodating ink; a plurality of pressure chambers to which the ink is distributed from the common ink chamber; a plurality of nozzles which are communicated with the respective pressure chambers, and through each of which a droplet of the ink is ejected; and a plurality of connecting passages connecting the common ink chamber with the respective pressure chambers. A part of each of the connecting passages is constituted by a groove formed along the one surface of the first plate and open in the one surface. An open end of the groove is covered by the second plate, and one of opposite ends of the groove is connected to the through-hole. The groove includes an orifice portion at which a cross-sectional area of the connecting passage as taken in a direction perpendicular to a direction of flow of the ink is minimized in the connecting passage, and an enlarged portion continuously interposed between an end of the orifice portion and an open end portion of the through-hole. The cross-sectional area of the connecting passage is larger at the enlarged portion than at the orifice portion.

According to the inkjet printhead of the invention, each pressure chamber to which a pressure is applied is connected to two opposite sides, i.e., the nozzle and the common ink chamber, and the groove constituting a part of the connecting passage connecting the common ink chamber with the pressure chamber includes the orifice portion where the cross-sectional area of the connecting passage is reduced to increase the resistance to the ink flow. A pressure wave from the pressure chamber is thus restrained from being transmitted to the common ink chamber, thereby enabling efficient transmission of the pressure wave to the nozzle.

When the grooves each in the form of a recess including the orifice portion and the enlarged portion are formed by wet etching in the plate where the through-holes are already formed, the etching tends to proceed at a higher speed near the through-holes than at the other part. In each groove, the enlarged portion is disposed between the orifice portion and the through-hole, thereby separating the orifice portion from the through-hole. Hence, the orifice portion is not affected, or is only slightly affected, by excessive etching due to the presence of the through-hole, thereby enabling to form the orifice portion in a designed shape or in a shape substantially identical with the designed shape. Consequently, the degree to which transmission of the pressure wave from the pressure chamber to the common ink chamber is prevented can be regulated as desired with high precision.

Further, the cross-sectional area of the groove is increased at the enlarged portion to make the resistance to the ink flow lower at the enlarged portion than at the orifice portion. Hence, even where the enlarged portion is excessively etched in forming the groove by wet etching because of the presence of the through-hole adjacent to the enlarged portion, this merely results in a further decrease in the resistance to the ink flow at this enlarged portion which is relatively low as compared to that at the orifice portion even in nominal dimensions, and thus the excessive etching does not affect the resistance to the ink flow at the orifice portion.

To attain the second object, the invention provides a method of producing the inkjet printhead as described above, wherein the first plate is prepared such that the through-holes are initially formed and then the grooves are formed by wet etching.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF PREFERRED EMBODIMENTS

Hereinafter, there will be described several presently preferred embodiments of the invention, by referring to the accompanying drawings.

Figure 1:
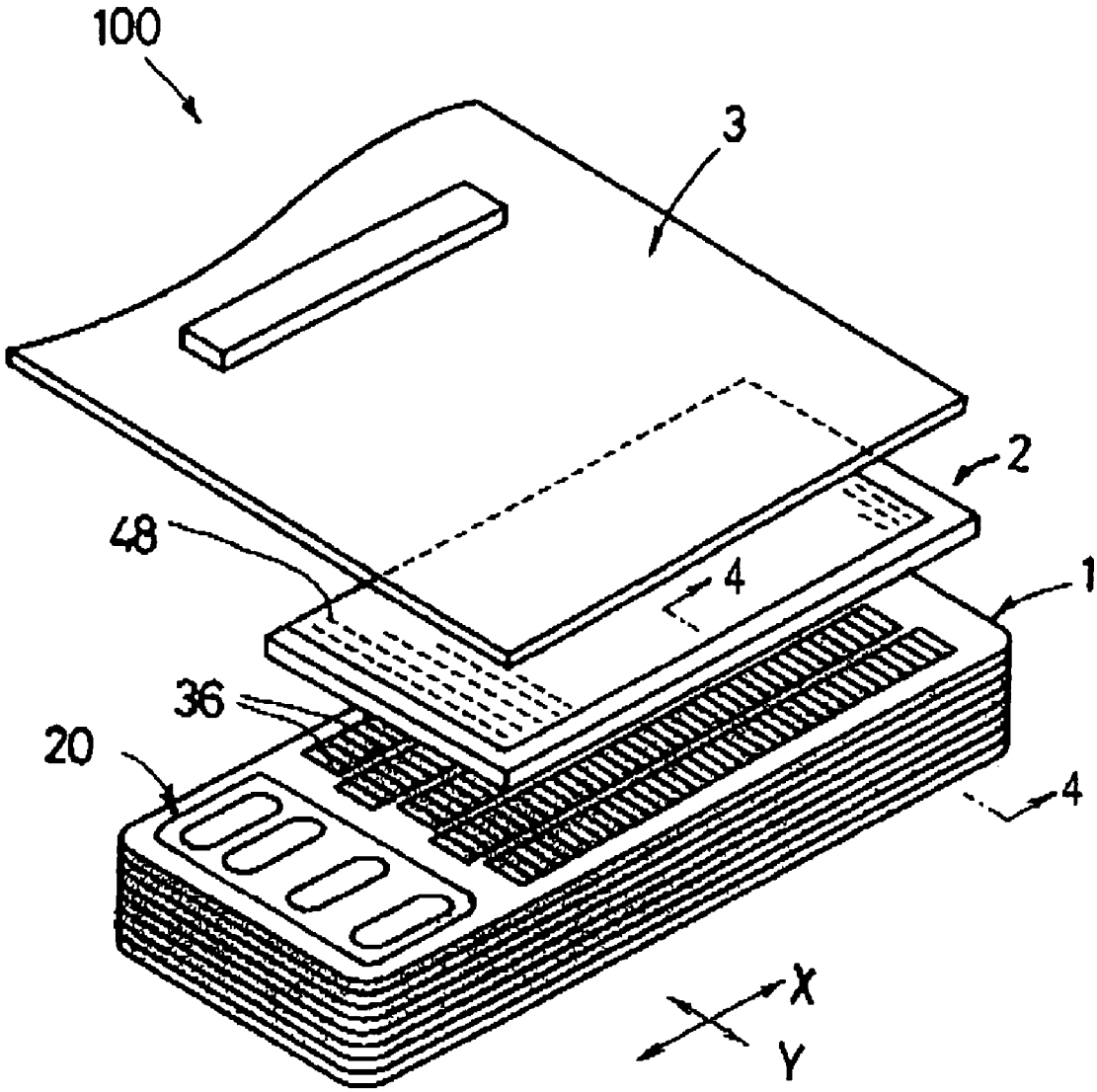
FIG. 1 is a perspective view of an inkjet printhead according to a first embodiment of the invention.

In FIG. 1, reference numeral 100 generally denotes a piezoelectric inkjet printhead according to the first embodiment. The inkjet printhead 100 includes a cavity unit 1 formed of a plurality of plates, and a planar piezoelectric actuator 2 fixed to the cavity unit 1. A flexible flat cable 3 (shown in FIGS. 1 and 4) is superposed on and fixed to an upper surface of the planar piezoelectric actuator 2 for connection with an external device. From nozzles 4 open in a lower surface of the cavity unit 1, droplets of ink are ejected downward.

Figure 2:
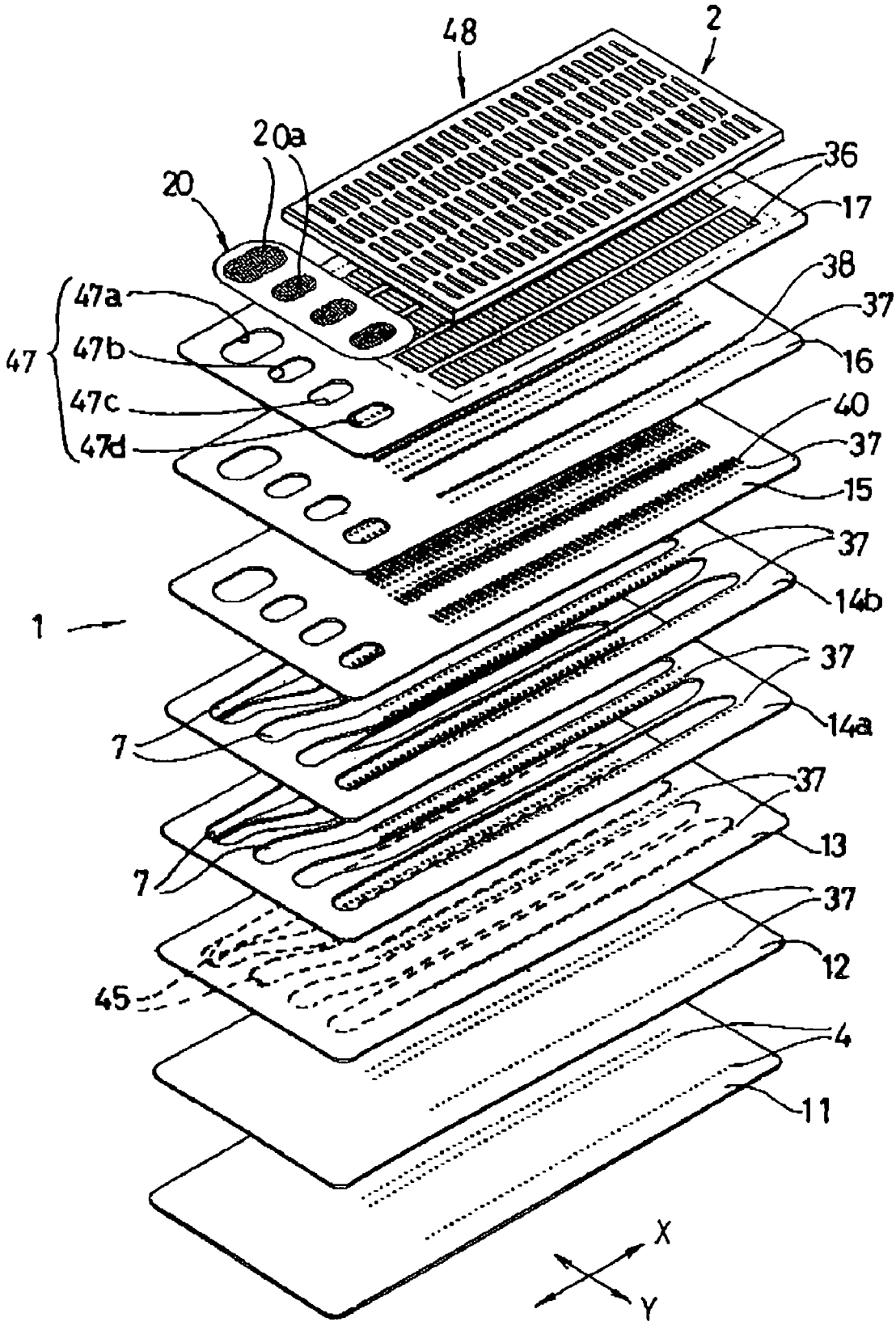
FIG. 2 is an exploded perspective view of the inkjet printhead.

More specifically, the cavity unit 1 of the first embodiment is formed by stacking, and bonding with an adhesive, eight thin plates one on another, as shown in FIG. 2. The eight plates are a nozzle plate 11, a spacer plate 12, a damper plate 13, two manifold plates 14*a*, 14*b*, a supply plate 15, a base plate 16, and a cavity plate 17.

Each of the plates 11-17 has a thickness of about 50-150 μm, and the nozzle plate 11 is made of synthetic resin such as polyimide while each of the other plates 12-17 is formed of a nickel alloy steel sheet containing 42% of nickel. Through the nozzle plate 11 are formed at small intervals a large number of nozzles 4 each for ejecting an ink droplet therethrough. Each nozzle 4 has a small diameter of about 20-23 μm. The nozzles 4 are arranged in five rows in a staggered fashion such that each of these nozzle rows extends along a longitudinal direction of the nozzle plate 11, i.e., an X-axis direction.

Figure 3:
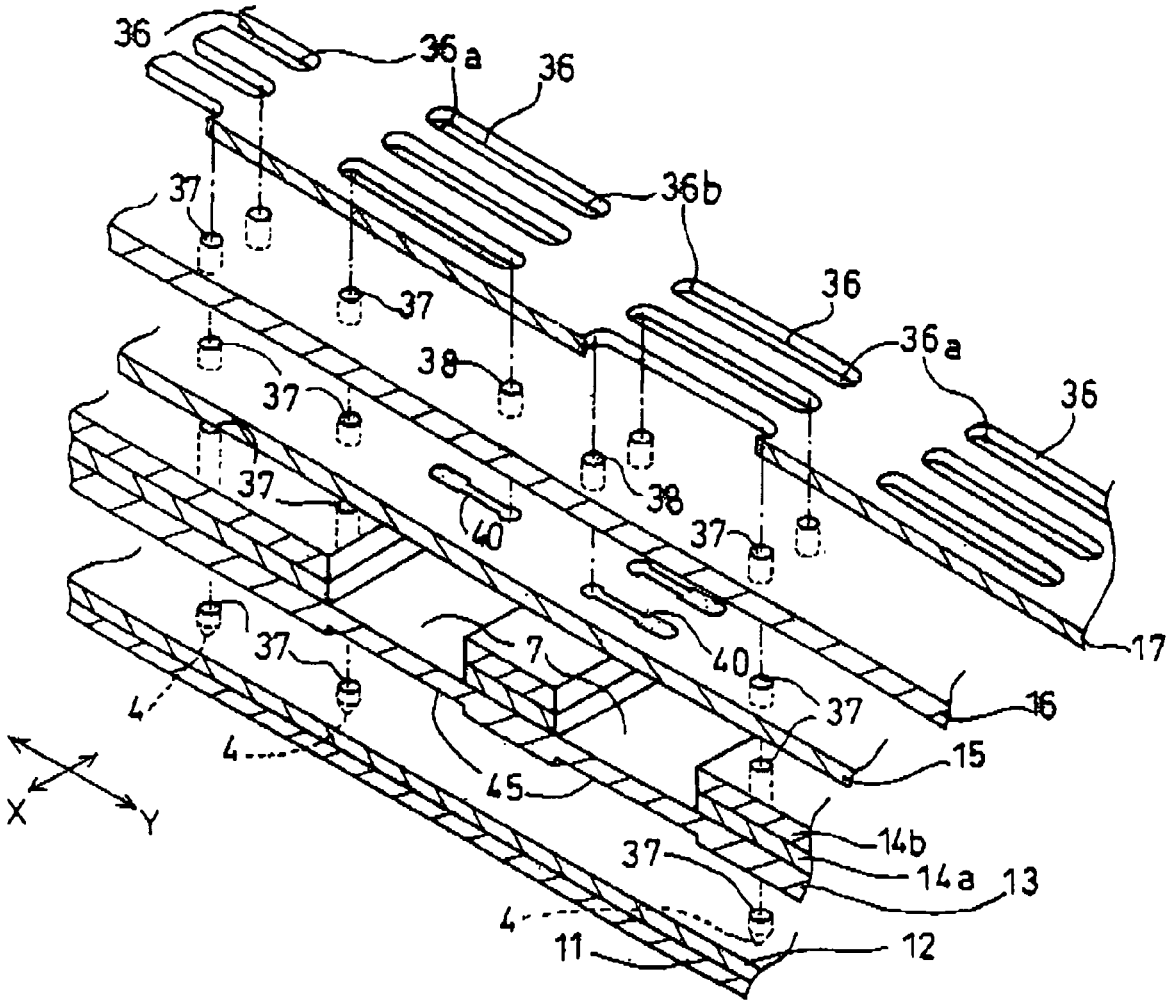
FIG. 3 is an exploded perspective view showing in enlargement a cavity unit of the inkjet printhead.

As shown in FIG. 3, a plurality of pressure chambers 36 are arranged in five rows in a staggered fashion such that each of the pressure chamber rows extends along the longitudinal direction of the cavity plate 17, i.e., the X-axis direction. Each pressure chamber 36 is elongate in plan view, and formed through the thickness of the cavity plate 17 such that a longitudinal direction of the pressure chamber 36 is parallel to a direction of shorter sides of the cavity unit 1, i.e., a Y-axis direction. A first longitudinal end 36*a* of each pressure chamber 36 is communicated with a corresponding one of the nozzles 4, while the other or second longitudinal end 36*b* of the pressure chamber 36 is communicated with a common ink chamber 7, as described later.

The first longitudinal end 36*a* of the pressure chamber is in communication with the corresponding one of the nozzles 4 formed through the nozzle plate 11, via one of a plurality of communication holes 37 of a small diameter formed through the supply plate 15, the base plate 16, and the two manifold plates 14*a*, 14*b*, the damper plate 13, and the spacer plate 12. The communication holes 37 are arranged in rows in a staggered fashion.

Figure 4:
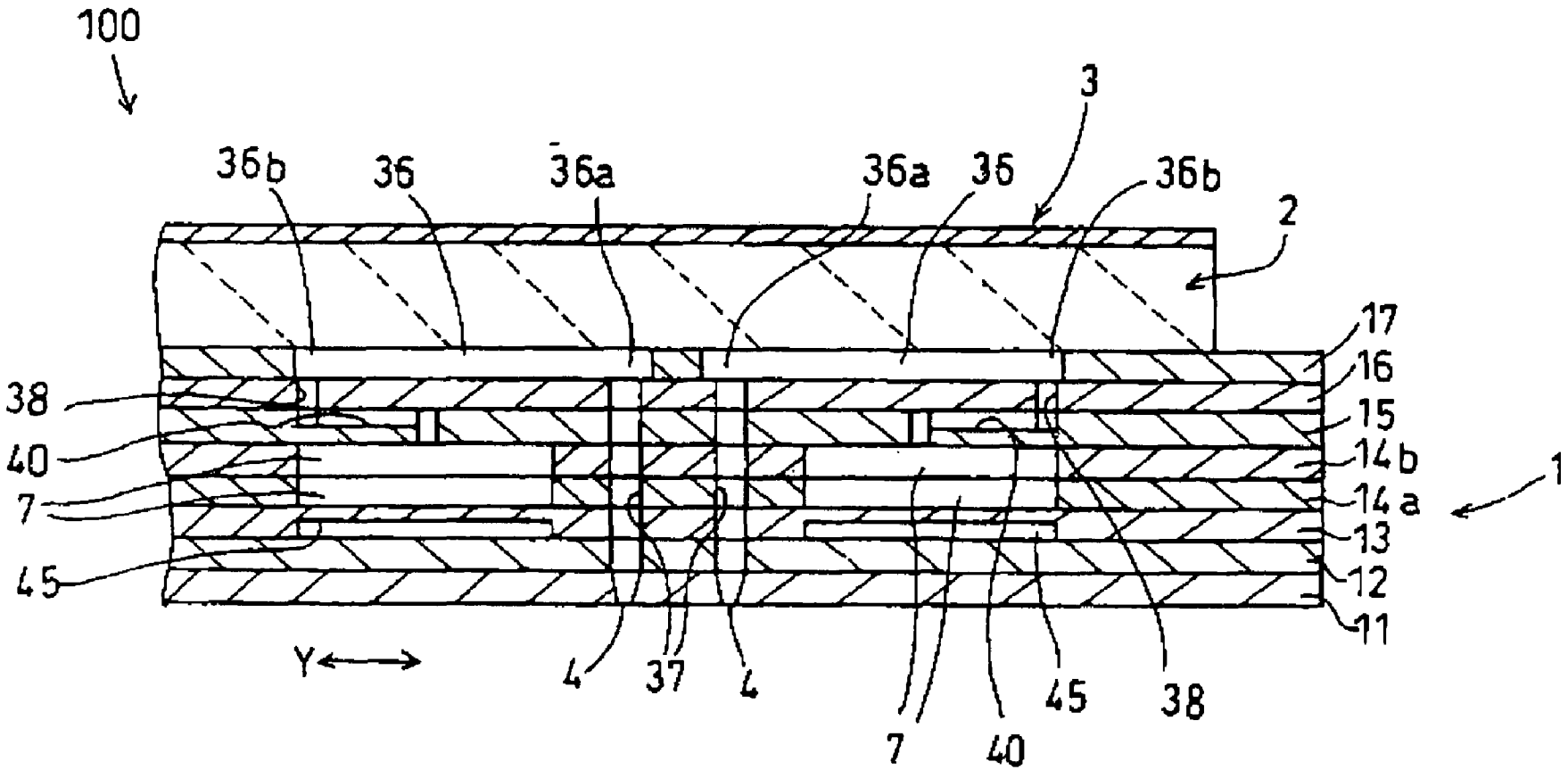
FIG. 4 is an enlarged cross-sectional view taken along line 4-4 in FIG. 1.

Through the two manifold plates 14*a*, 14*b*, there are formed five common ink chambers 7 each elongate in a longitudinal direction of the manifold plates 14*a*, 14*b*, i.e., the X-axis direction, such that the common ink chambers 7 extend along the respectively corresponding nozzle rows. That is, as shown in FIGS. 2 and 4, two manifold plates 14*a*, 14*b* are laminated, and an upper surface of the laminate is covered by the supply plate 15 while a lower surface of the laminate is covered by the damper plate 13, so that five closed common ink chambers (or manifold chambers) 7 are formed. Each common ink chamber 7 extends along the extending direction of each pressure chamber row or each nozzle row, with a part of the common ink chamber 7 overlapping each of the pressure chambers 36 of the corresponding pressure chamber row when seen in a direction of stacking of the plates 11-17.

As shown in FIGS. 3 and 4, on a lower surface of the damper plate 13 immediately under the manifold plate 14*a*, there are formed five damper chambers 45 at positions corresponding to the common ink chambers 7 but not in communication with the common ink chambers 7. Each damper chamber 45 takes the form of a recess, and the position and shape thereof are the same as those of the corresponding common ink chamber 7, as shown in FIG. 2. The damper plate 18 is an elastically deformable metallic material, and thus a thin ceiling portion over each damper chamber 46 can freely vibrate to both of the opposite sides, namely, to the side of the common ink chamber 7 as well as to the side of the damper chamber 45. Even where a pressure change occurring in the pressure chamber 36 upon ejection of an ink droplet is transmitted to the common ink chamber 7, the ceiling portion elastically deforms and vibrates to absorb or damp the pressure change, thereby giving a damping effect. In this way, a crosstalk, which is a transmission of a pressure change from one pressure chamber 36 to another pressure chamber 36, is prevented.

Figure 5:
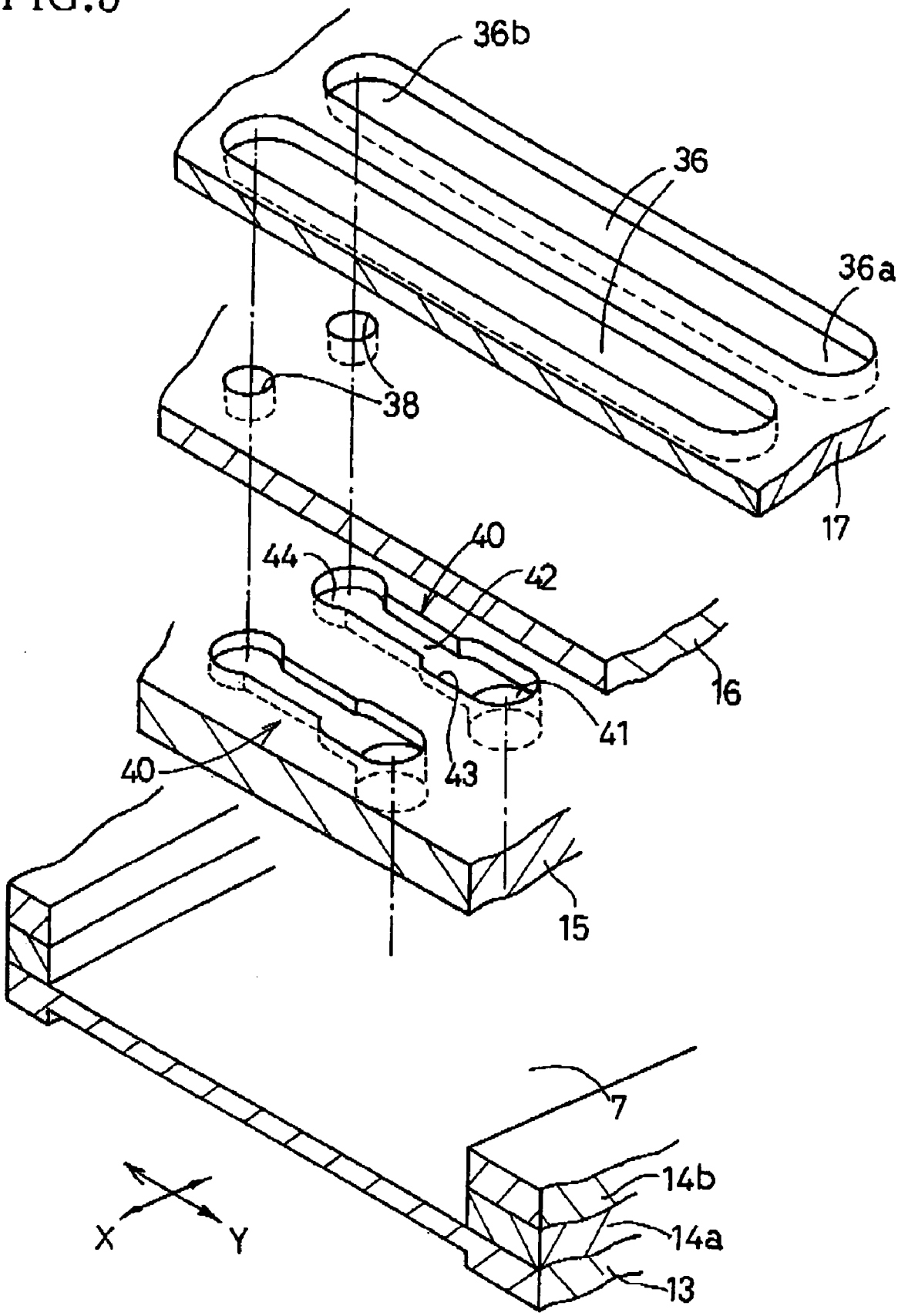
FIG. 5 is an exploded perspective view showing in enlargement an orifice portion of a connecting passage in the cavity unit and a vicinity thereof.
Figure 6A:
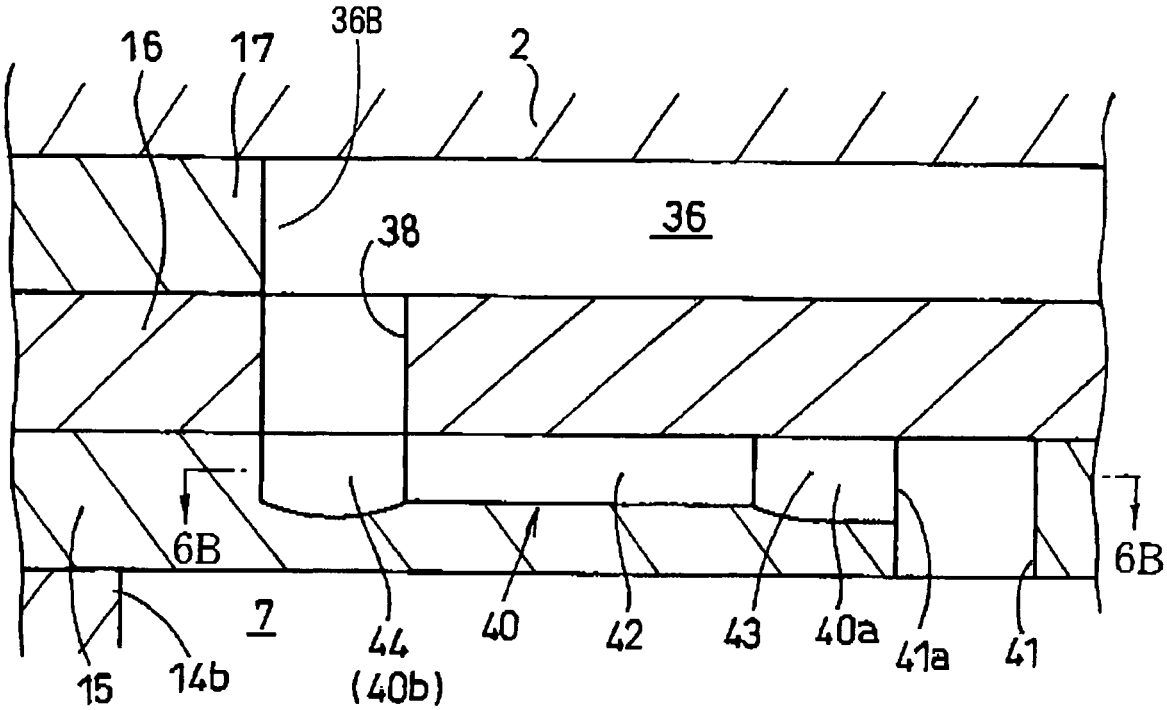
FIG. 6A is a cross-sectional view of the orifice portion and a vicinity thereof.
Figure 6B:
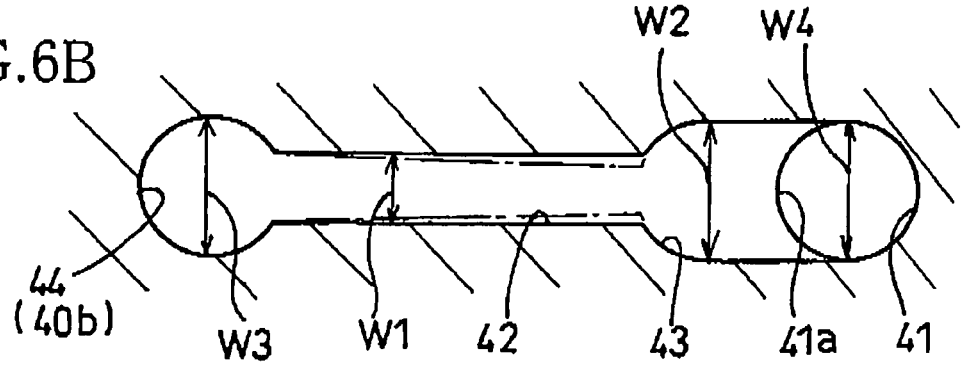
FIG. 6B is a cross-sectional view taken along line 6B-6B in FIG. 6A.

Between the cavity plate 17 where the pressure chambers 36 are formed and the manifold plate 14*b* where the common ink chambers 7 are formed, there are interposed two plates, namely, the base plate 16 and the supply plate 15. In the fist embodiment, the base plate 16 immediately under the cavity plate 17 corresponds to a second plate as defined in the appended claims, and connecting holes 38, each of which is connected to the second longitudinal end 36*b* of the corresponding pressure chamber 36, are formed through the base plate 16, as shown in FIGS. 5, 6A and 6B. The supply plate 15 immediately under the base plate 16 corresponds to a first plate as defined in the appended claims, and recesses or grooves 40 are formed on a major surface of the supply plate 15 to open to the side of the base plate 16, that is, open upward as seen in FIG. 4. Each groove 40 constitutes a part of a connecting passage that connects a pressure chamber with a common ink chamber. The open end of each groove 40 is covered by the base plate 16 except at a second end 40*b* of the groove 40, while a first end 40*a* of the groove 40 is connected to a corresponding one of a plurality of through-holes 41 formed in the supply plate 15.

The groove 40 includes an orifice portion 42 and an enlarged portion 43. At the orifice portion 42, a cross-sectional area of the connecting passage, as taken in a direction perpendicular to flow of the ink, is minimized so that a resistance of the connecting passage to the ink flow (hereinafter simply referred to as "the flow resistance") is the highest at the orifice portion 42. Opposite ends of the enlarged portion are connected to an end of the orifice portion 42 and an open end portion 41*a* of the through-hole 41, respectively, and the cross-sectional area of the connecting passage taken in the above-described direction is larger at the enlarged portion 43 than at the orifice portion 42.

A width W2 of the enlarged portion 43, which is a dimension in a direction along a surface of the supply plate 15 and perpendicular to the ink flow, is larger than a width or dimension W1 of the orifice portion 42 in the same direction. Accordingly, W2>W1. At the second end 40*b* of the groove 40, a depth of the groove 40 is increased, thereby forming a recessed portion 44 where the cross-sectional area of the connecting passage taken in the direction perpendicular to the direction of the ink flow is larger than at the orifice portion 42. A width or dimension WS of this recessed portion 44 in the direction along the surface of the supply plate 15 and perpendicular to the ink flow, is larger than the width W1 of the orifice portion 42. That is, W3>W1. The cross-sectional area of the connecting passage at the recessed portion 44 is larger than at the orifice portion 42. That is, the orifice portion 42 is interposed between the enlarged portion 43 and the recessed portion 44 both of which have a width larger than that of the orifice portion 42.

The width W2 of the enlarged portion 43 is preferably larger than 1.3 times the width W1 of the orifice portion, more preferably larger than 1.6 times the width W1, and further preferably larger than two times the width W1.

According to the embodiment where the width W2 of the enlarged portion 43 is larger than that W1 of the orifice portion 42, the cross-sectional area of the enlarged portion 43 can be made larger than that of the orifice portion 42 even when the enlarged portion 43 and the orifice portion 42 are formed concurrently. Hence, a step of forming these portions 42, 43 can be simplified.

The orifice portion 42 and the enlarged portion 43 have respective lengths in the direction of the ink flow. The length of the orifice portion 42 in the direction of the ink flow is preferably larger than the width W1 of the orifice portion, more preferably larger than 1.5 times the width W1, further preferably larger than two times the width W1, and still further preferably larger than three times the width W1.

According to the embodiment where the orifice portion 42 has the length in the direction of the ink flow as described above, the flow resistance of the orifice portion 42 as a whole can be set at a desired value without extremely decreasing the width W1 of the orifice portion 42 which is a dimension perpendicular to the direction of the ink flow. Hence, as compared to a case where the same flow resistance is achieved by extremely decreasing the length in the direction of the ink flow as well as the width W1 of the orifice portion 42, an influence of a variation in the dimensional accuracy and precision of the orifice portion 42 on the flow resistance can be reduced.

The through-hole 41 formed in the supply plate 15 is connected to the common ink chamber 7, and the recessed portion 44 is connected to the second longitudinal end 36*b* of the pressure chamber 36 via the connecting hole 38 formed through the base plate 16.

In this embodiment, the groove 40 is opposed to the connecting hole 38 formed through the base plate 16 as a second plate, at its recessed portion 44 having a cross-sectional area larger than that of the orifice portion 42. Hence, making the cross-sectional area of the recessed portion 44 large by increasing the width W3 or a diameter of an open end of the recessed portion 44, facilitates alignment between the recessed portion 44 and the connecting hole 38, that is, alignment between the supply plate 15 and the base plate 16 as a first plate and a second plate, respectively.

In this embodiment, the ink supplied from the common ink chamber 7 is distributed to the pressure chambers 36 through the connecting passages each including the through-hole 41, the enlarged portion 43, the orifice portion 42, the recessed portion 44, and the connecting hole 38. Although a width W4 (or a dimension in the same direction as the width W2 of the enlarged portion 43) of the through-hole 41 continuous with the enlarged portion 43 is the same as the width W2 of the enlarged portion 43 in this embodiment, as shown in FIG. 6B, the width W4 of the through-hole 41 may be any, as long as not larger than the width W2.

As shown in FIG. 2, at an end portion of each of the cavity plate 17, the base plate 16, and the supply plate 15 at a shorter side thereof, four through-holes are formed so that four ink supply ports 47 are formed by these through-holes as vertically aligned when the plates 15-17 are stacked. Ink from an ink supply source is introduced into end portions of the respective common ink chambers 7 through the ink supply ports 47. The four ink supply ports 47 are individually denoted by 47*a*, 47*b*, 47*c*, 47*d* as seen from left to right in FIG. 2.

In this embodiment, four ink supply ports 47 and five common ink chambers 7 are formed, as shown in FIG. 2, that is, the ink supply port 47*a* is connected to two common ink chambers 7, 7, since black ink that is more frequently used than the other color inks is supplied into the ink supply port 47*a*. Into the other ink supply ports 47*b*, 47*c*, 47*d*, yellow, magenta, and cyan inks are respectively supplied. A filter member 20 is bonded with an adhesive or others to the cavity plate 17 such that filtering portions 20*a* of the filter member 20 respectively cover the ink supply ports 47*a*, 47*b*, 47*c*, 47*d*, as shown in FIGS. 1 and 2.

There will be described a structure of the piezoelectric actuator 2. Although not shown, the piezoelectric actuator 2 has a laminar structure formed of a plurality of piezoelectric sheets, similarly to an actuator disclosed in JP-A-4-341853, for instance. Each piezoelectric sheet has a thickness of about 30 μm. On an upper major surface of each of an even-numbered piezoelectric sheet as counted from the bottom, narrow individual electrodes are formed in rows each extending along the longitudinal direction of the cavity unit 1 or the X-axis direction such that the individual electrodes positionally correspond to the pressure chambers 36. On an upper major surface of each odd-numbered piezoelectric sheet as counted from the bottom, a plurality of common electrodes each common to a plurality of the pressure chambers 36 are formed. On an upper surface of the piezoelectric sheet on top are disposed surface electrodes 48 of two kinds, that is, surface electrodes electrically connected to the individual electrodes, and surface electrodes electrically connected to the common electrodes.

Over an entirety of a lower surface of the planar piezoelectric actuator 2, which lower surface is a major surface to be opposed to the pressure chambers 36, an adhesive sheet (not shown) made of an ink impervious synthetic resin is attached as an adhesive, and then the piezoelectric actuator 2 is bonded and fixed to the cavity unit 1, such that the individual electrodes of the actuator 2 are respectively opposed to the pressure chambers 36 of the cavity unit 1. The flexible flat cable 3 as shown in FIG. 4 is superposed on and pressed against an upper surface of the piezoelectric actuator 2, so that various wiring patterns (not shown) of the flexible flat cable are electrically connected with the surface electrodes 48 on the cavity unit 1.

In the supply plate 15 as one of the metallic plates constituting the cavity unit 1, the grooves 40 and the through-holes 41 are formed as described above. When forming the grooves 40 and the through-holes 41, the through-holes 41 are first formed through the supply plate 15 by wet etching. The through-holes 41 may be formed by other methods than wet etching. Then, the grooves 40 each including the orifice portion 42, the enlarged portion 43, and the recessed portion 44 are formed by wet etching. On both of opposite surfaces of the supply plate 15, each part not to be etched is covered with a protective film. At an end part of the orifice portion 42 on the side of the enlarged portion 43, the etching process may proceed rapidly depending on a distance between this end part of the orifice portion 42 and the open end portion 41*a* of the through-hole 41. More specifically, where it is designed such that the end part of the orifice portion 42 on the side of the enlarged portion 43 is near the through-hole 41, the etching is affected by the presence of the through-hole 41 and proceeds at a high speed at the end part. In such a case, taking account of the inevitable widening of the orifice portion 42 at the end part in the etching process, it is desired that a width of an opening of the protective film at a place corresponding to the end part of the orifice portion 42 is made smaller than the width W1, as indicated by chain line in FIG. 6B. In FIG. 6B, the decrease in the width of the protective film is emphasized.

More specifically, this wet etching process is implemented such that an etchant is flowed on the surface of the supply plate 15 (constituting a first plate) in which the grooves 40 open, in a direction from the side of the second ends 40*b* of the grooves 40 toward the first ends 40*a* of the grooves 40.

In the etching process, the etchant tends to flow toward the already formed through-holes 41, thereby increasing the etching speed around the through-holes 41 as compared to the other part, as has been conventionally seen. However, as described above, in the present embodiment the orifice portion 42 is separated from the through-hole 41 and thus the etchant flows at a steady speed over an entirety of the orifice portion 42, thereby enabling to reliably form the orifice portion 42 in a desired, nominal cross-sectional shape throughout its length.

Further, in the wet etching process, the etchant tends to be turbulent at the second end 40*b* of each groove 40. That is, the flow of the etchant is instable at places corresponding to the second ends 40*b*. However, according to the present embodiment where the orifice portion 42 is not located at an end of the groove 40 on the side from which the etchant is flowed on the surface of the supply plate 15, the turbulence of the etchant flow is restrained from affecting the finished shape of the orifice portion 42. Hence, the orifice portion 42 can be formed in a desired shape with high stability.

At the enlarged portion 43 between the orifice portion 42 and the through-hole 41, the cross-sectional area of the groove 40 is made larger than at the orifice portion 42, thereby reducing the flow resistance at the enlarged portion 43. Hence, even where the presence of the through-hole 41 adjacent to the enlarged portion 43 affects, namely, increases, the finished width and depth of the enlarged portion 43, and the finished shape of the enlarged portion 43 is made different from a nominal, designed shape thereof, this merely results in a further decrease in the flow resistance at the enlarged portion 43, and the flow resistance is not changed at the orifice portion 42. The recessed portion 44 and the enlarged portion 43 have the width larger than that of the orifice portion 42, and thus even where these portions 43, 44 are formed with an intention to make the depth of the portions 43, 44 the same as that of the orifice portion 42, an actual depth of the portions 43, 44 as finished becomes larger than that of the orifice portion 42, as shown in FIG. 6A, since a variation in the speed of the etching process occurs in the groove 40. However, as described above, the cross-sectional area increases at the enlarged portion 43 and the recessed portion 44 with an increase in the depth at these portions 43, 44, but this merely causes a further decrease in the flow resistance at these portions 43, 44, which is relatively small even without such an increase in the cross-sectional area. That is, the flow resistance of the orifice portion 42 is not affected at all by the increase in the cross-sectional area at the enlarged portion 43 and the recessed portion 44.

The width W2 of the enlarged portion 43 is set to be equal to or larger than the width W4 of the through-hole 41. In other words, it is designed such that an edge or a corner protruding inward in the width direction is not formed at a boundary between the enlarged portion 43 and the through-hole 41. Hence, even where the speed of the flow of the etchant increases near the through-hole 41, the shape of the enlarged portion 43 does not much change. Where the width W2 of the enlarged portion 43 is made larger than the width W4 of the through-hole 41, the change in the shape of the enlarged portion 43 is further restrained than where the width W2 of the enlarged portion 43 is made equal to the width W4 of the through-hole 41.

In the cavity unit 1 having the thus configured orifice portions 42, the ink supplied into each common ink chamber 7 as an ink supply channel, through the ink supply port, is distributed to the pressure chambers 36 via the grooves 40 formed in the supply plate 15 and the connecting holes 38 formed through the base plate 16. When a pressure chamber 36 is selectively applied with a pressure by driving the piezoelectric actuator 2, the ink inside that pressure chamber 36 is flowed to the nozzle 4 in communication with the pressure chamber 36 through a corresponding communication hole 37, so as to be ejected from the nozzle 4 to the exterior of the printhead 100.

According to the first embodiment, since the flow resistance of the orifice portion 42 of the groove 40 is regulated at a desired level relatively precisely, and thus the transmission of a pressure wave occurring in the ink upon application of a pressure to a pressure chamber 36, to a corresponding common ink chamber 7, can be regulated as desired with high precision, thereby enabling to transmit the pressure wave to the nozzle 4 relatively precisely as desired. Hence, recording with high accuracy and precision is achieved.

Figure 7A:
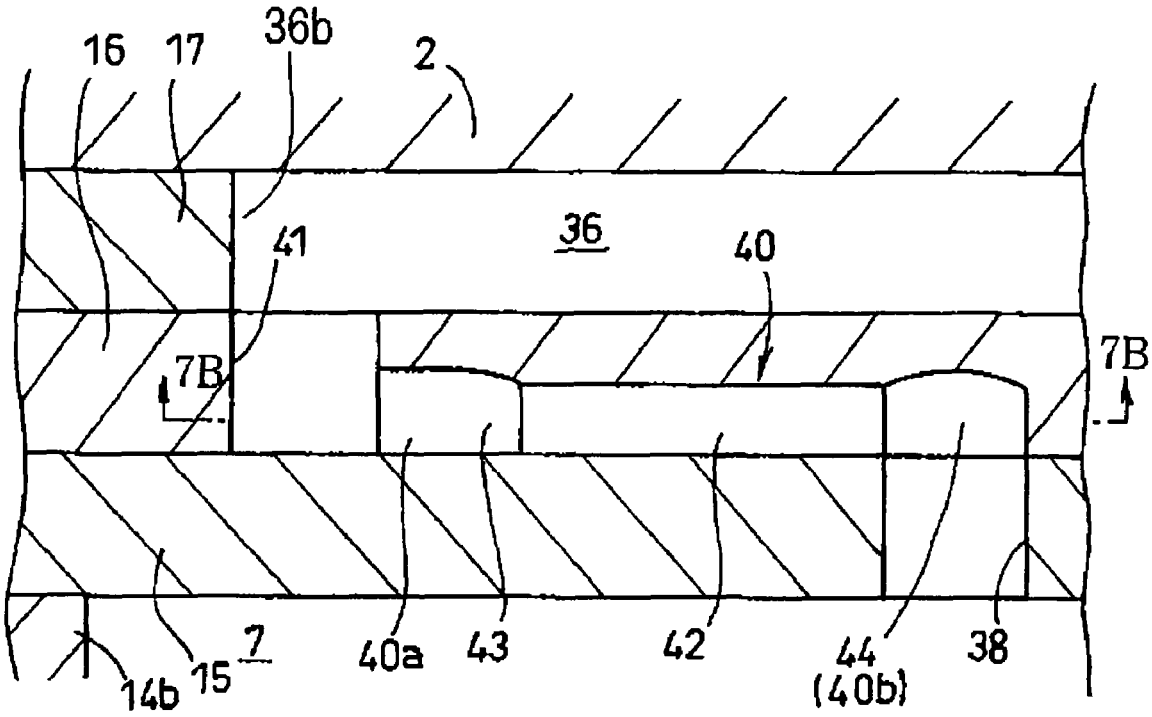
FIG. 7A is a cross-sectional view of an orifice portion of a connecting passage in a cavity unit of an inkjet printhead according to a second embodiment of the invention.
Figure 7B:
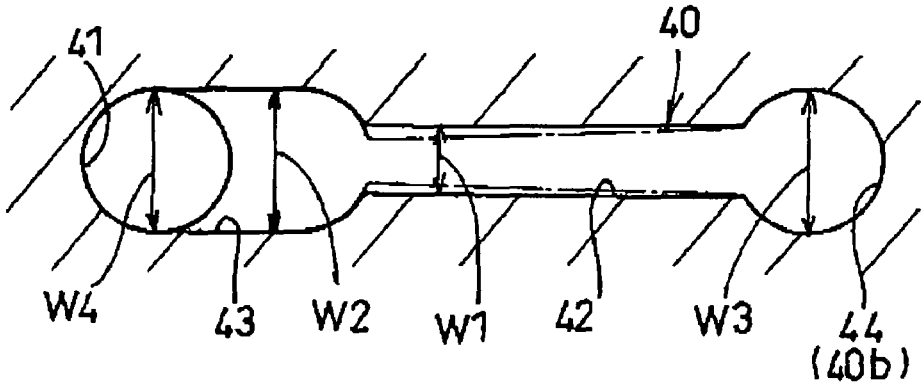
FIG. 7B is a cross-sectional view taken along line 7B-7B in FIG. 7A.

There will be now described an inkjet printhead according to a second embodiment of the invention, by referring to FIGS. 7A and 7B. FIG. 7A is a cross-sectional view of an orifice portion in a groove of a connecting passage formed in the inkjet printhead and the vicinity thereof, and FIG. 7B is a cross-sectional view taken along line 7B-7B in FIG. 7A. Since the second embodiment is a modification of the first embodiment, namely, the second embodiment is different from the first embodiment merely in the structure of the connecting passage including the groove 40 and the connecting hole 38, the parts and elements corresponding to those of the first embodiment will be denoted by the same reference numerals and description thereof is dispensed with.

In the second embodiment, a base plate 16 and a supply plate 15 are interposed between a cavity plate 17 where pressure chambers 36 are formed, and a manifold plate 14*b* where common ink chambers 7 are formed, and connecting holes 38 are formed through the supply plate 15 and grooves 40 are formed in the base plate 16. That is, in the second embodiment, the supply plate 15 corresponds to a second plate as defined in the appended claims, and the base plate 16 corresponds to a first plate as defined in the claims. Each groove 40 is formed in the form of a recess extending along a major surface of the base plate 16 and open toward the supply plate 15, i.e., downward as seen in FIG. 7A. An open end of the groove 40 is covered by the supply plate 15 except at a second end 40*b* thereof, and a first end 40*a* of the groove 40 is connected to a longitudinal end 36*b* of the pressure chamber 36 via a through-hole 41 formed in the base plate 16.

The groove 40 includes an orifice portion 42 having a width W1, and an enlarged portion 43 having a width W2 which is larger than the width W1. The second end 40*b* of the groove 40 takes the form of a recessed portion 44 having a width W3 that is larger than the width W1 and communicating with a corresponding one of the common ink chambers 7 via one of the connecting holes 38 formed through the supply plate 15. Hence, in the second embodiment, the ink supplied from the common ink chamber 7 is distributed to the pressure chambers 36 via the connecting holes 38, the recessed portions 44, the orifice portions 42, the enlarged portions 43, and the through-holes 41.

In the second embodiment, too, the orifice portion 42 is separated from the through-hole 41, and the enlarged portion 43 is formed between the orifice portion 42 and the through-hole 41. Hence, the orifice portion 42 can be easily formed in an accurate and precise shape, similarly to the first embodiment.

Figure 8A:
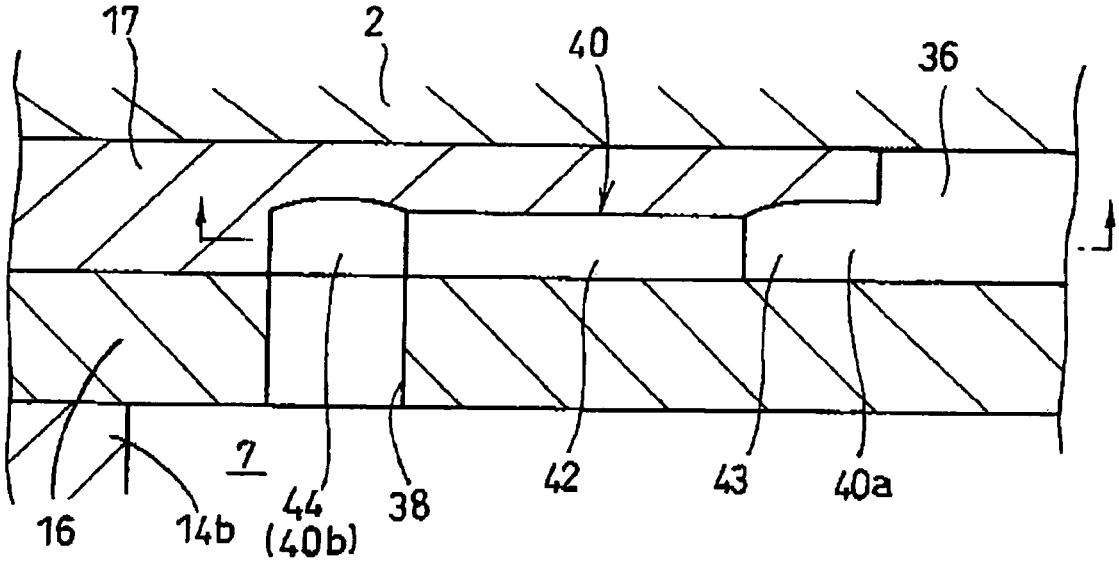
FIG. 8A is a cross-sectional view of an orifice portion of a connecting passage in a cavity unit of an inkjet printhead according to a third embodiment of the invention.
Figure 8B:
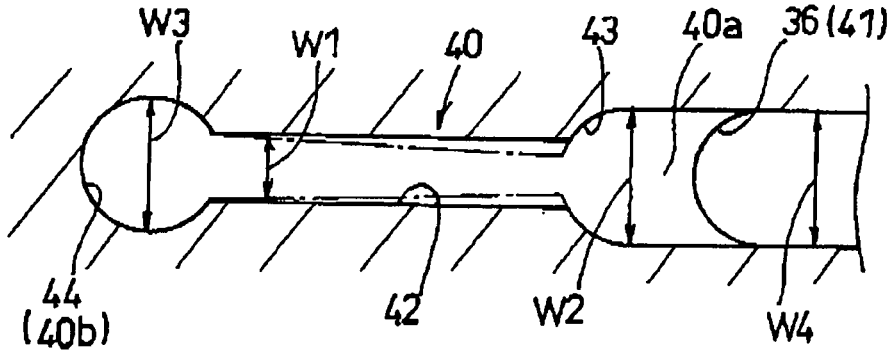
FIG. 8B is a cross-sectional view taken along line 8B-8B in FIG. 8A.

Referring next to FIGS. 8A and 8B, an inkjet printhead according to a third embodiment of the invention will be described. FIG. 8A is a cross-sectional view of an orifice portion in a groove of a connecting passage formed in the inkjet printhead and the vicinity thereof according to the third embodiment, and FIG. 8B is a cross-sectional view taken along line 8B-8B in FIG. 8A. Since the third embodiment is also a modification of the first embodiment, that is, the third embodiment is different from the first embodiment merely in the structure of the connecting passage including the groove 40 and the connecting hole 38, the parts and elements corresponding to those in the first embodiment will be denoted by the same reference numerals and description thereof is dispensed with.

According to the third embodiment, only a base plate 16 is interposed between a cavity plate 17 where pressure chambers 36 are formed and a manifold plate 14*a* where common ink chambers 7 are formed. That is, in the third embodiment, the supply plate 15 as seen in the first embodiment is not included. The grooves 40 are formed in the cavity plate 17 in which the pressure chambers 36 are also formed. Thus, the cavity plate 17 corresponds to a first plate as defined in the appended claims, and the base plate 16 corresponds to a second plate as defined in the claims.

In a major surface of the cavity plate 17, each groove 40 is formed as a recess open toward the base plate 16, i.e., downward as seen in FIG. 8A. A first one 40*a* of opposite ends of each groove 40 (corresponding to "one of opposite ends of a groove" as defined in the appended claims) is directly connected to one of the pressure chambers 36 formed through the thickness of the cavity plate 17. That is, in the third embodiment, the pressure chamber 36 formed through the cavity plate 17 corresponds to a through-hole as defined in the appended claims. An open end of the groove 40 and that of the pressure chamber 36 continuous with the groove 40 are covered by the base plate 16, except at a second or the other end 40*b* of the groove 40 (corresponding to "the other end of the groove" as defined in the appended claims) and a part of the pressure chamber 36 (which corresponds to the communication hole 37) communicated with a nozzle 4.

The groove 40 has an orifice portion 42 having a width W1 and an enlarged portion 43 having a width W2 larger than the width W1, and the second end 40*b* of the groove 40 takes the form of a recessed portion 44 having a width W3 which is larger than the width W1 and communicating with a corresponding one of the common ink chambers 7 via one of the connecting holes 38 formed in the base plate 16. Hence, in the third embodiment, the ink supplied from the common ink chamber 7 is distributed to the pressure chambers 36 via the connecting holes 38, the recessed portions 44, the orifice portions 42, and the enlarged portions 43.

In the third embodiment, the pressure chambers 36 are first formed through the cavity plate 17, and then the grooves 40 are formed by etching away the cavity plate 17 halfway in the thickness thereof with an etchant. However, since the orifice portion 42 is separated from the pressure chamber 36 constituting a through-hole, and the enlarged portion 43 is formed between the orifice portion 42 and the pressure chamber 36, the orifice portion 42 can be easily formed in an accurate and precise shape, similarly to the first embodiment.

In each of the above-described embodiments, a piezoelectric actuator is used as an actuator for pressurizing the ink in each pressure chamber. However, actuators of other types than the piezoelectric type may be employed

What is claimed is:

1. An inkjet printhead comprising a cavity unit formed by laminating a plurality of plates which include a first plate having a plurality of through-holes and a second plate, the first plate and second plate being interposed between other plates of the plurality of plates, the cavity unit having:

a common ink chamber accommodating ink;

a plurality of pressure chambers to which the ink is distributed from the common ink chamber;

a plurality of nozzles which are communicated with the respective pressure chambers, and through each of which a droplet of the ink is ejected; and a plurality of connecting passages connecting the common ink chamber with the respective pressure chambers, a part of each of the connecting passages being constituted by a groove formed along one surface of the first plate and open in the one surface, an open end of the groove being covered by the second plate, and one of opposite ends of the groove being connected to the through-hole, the groove including:

an orifice portion at which a cross-sectional area of the connecting passage as taken in a direction perpendicular to a direction of flow of the ink is minimized in the connecting passage; and an enlarged portion continuously interposed between an end of the orifice portion and an open end portion of the through-hole, the cross-sectional area of the connecting passage being larger at the enlarged portion than at the orifice portion;

wherein the connecting passage further comprises a connecting hole formed through the second plate and in communication with the other end of the groove which end takes the form of a recessed portion opposed to the connecting hole, the cross-sectional area of the connecting passage as taken in the direction perpendicular to the direction of the ink flow being larger at the recessed portion than at the orifice portion, and the orifice portion being disposed between the recessed portion and the enlarged portion.

2. The inkjet printhead according to claim 1, wherein a length of the orifice portion in the direction of the ink flow is larger than a width of the orifice portion in a direction along the one surface of the first plate and perpendicular to the direction of the ink flow.

3. The inkjet printhead according to claim 2, wherein the length of the orifice portion in the direction of the ink flow is larger than 1.5 times the width of the orifice portion.

4. The inkjet printhead according to claim 3, wherein the length of the orifice portion in the direction of the ink flow is larger than two times the width of the orifice portion.

5. The inkjet printhead according to claim 4, wherein the length of the orifice portion in the direction of the ink flow is larger than three times the width of the orifice portion.

6. The inkjet printhead according to claim 1, wherein a length of the enlarged portion in the direction of the ink flow is larger than half a width of the enlarged portion in a direction along the one surface of the first plate and perpendicular to the direction of the ink flow.

7. The inkjet printhead according to claim 6, wherein the length of the enlarged portion in the direction of the ink flow is larger than ¾ times the width of the enlarged portion.

8. The inkjet printhead according to claim 7, wherein the length of the enlarged portion in the direction of the ink flow is larger than the width of the enlarged portion.

9. The inkjet printhead according to claim 1, wherein a width of the enlarged portion in a direction along the one surface of the first plate and perpendicular to the direction of the ink flow is larger than that of the orifice portion.

10. The inkjet printhead according to claim 1, wherein the first plate and the second plate are interposed between a third plate in which the common ink chamber is formed and a fourth plate in which the pressure chambers are formed, and the first through fourth plates are integrally laminated.

11. The inkjet printhead according to claim 10, wherein the third plate in which the common ink chamber is formed, the first plate, the second plate, and the fourth plate in which the pressure chambers are formed are stacked in this order, and the through-hole formed in the first plate is connected to the common ink chamber and the connecting hole formed in the second plate is connected to the pressure chamber.

12. The inkjet printhead according to claim 10, wherein the third plate in which the common ink chamber is formed, the second plate, the first plate, and the fourth plate in which the pressure chambers are formed are stacked in this order, and the through-hole formed in the first plate is connected to the pressure chamber and the connecting hole formed in the second plate is connected to the common ink chamber.

13. The inkjet printhead according to claim 1, wherein each pressure chamber is formed as the through-hole in the first plate, and the other end of the groove is connected to the common ink chamber.

14. The inkjet printhead according to claim 13, wherein a connecting hole connecting the other end of the groove with the common ink chamber is formed in the second plate.

15. The inkjet printhead according to claim 14, wherein a recessed portion is formed at the other end of the groove and opposed to the connecting hole, a cross-sectional area of the connecting passage as taken in the direction perpendicular to the direction of the ink flow being larger at the recessed portion than at the orifice portion, and the orifice portion being disposed between the recessed portion and the enlarged portion.

16. The inkjet printhead according to claim 1, further comprising an actuator opposed to the pressure chambers of the cavity unit, the actuator selectively changing an inner volume of each pressure chamber so as to pressurize the ink in the pressure chamber to eject the ink droplet from the corresponding nozzle.

17. A method of producing the inkjet printhead according to claim 1, wherein the first plate is prepared such that the through-holes are initially formed and then the grooves are formed by wet etching.

18. The method according to claim 17, wherein the wet etching is implemented such that an etchant is flowed on the one surface of the first plate in a direction from the side of the other end of the groove toward the side of the one end of the groove which end is connected to the through-hole.

* * * * *